United States Patent [19]

Blankenship

[11] 4,307,734

[45] Dec. 29, 1981

[54] SNUFF DISPENSER

[75] Inventor: Thomas M. Blankenship, E. Moline, Ill.

[73] Assignee: B & B Inventors & Marketers, Inc., Moline, Ill.

[21] Appl. No.: 161,835

[22] Filed: Jun. 23, 1980

[51] Int. Cl.[3] ..... A24F 23/00

[52] U.S. Cl. ..... 131/329; 128/203.15; 222/142.9; 206/533

[58] Field of Search ..... 131/170, 180; 128/203.15; 221/91, 86, 203.15; 222/142.9; 206/533, 536 , 538, 539

[56] References Cited

U.S. PATENT DOCUMENTS

| | | | |
|---|---|---|---|
| 2,587,215 | 2/1952 | Priestly | 128/203.15 |
| 2,603,216 | 7/1952 | Taplin et al. | 128/203.15 |
| 2,672,865 | 3/1954 | Wilis | 128/203.15 |
| 3,326,360 | 6/1967 | Lyon, Jr. | 206/533 |
| 3,870,192 | 3/1975 | Haley | 221/86 |
| 4,105,027 | 8/1978 | Lundquist | 128/203.15 |
| 4,147,166 | 4/1979 | Hansen | 128/266 |
| 4,171,703 | 10/1979 | Locke | 131/180 |

*Primary Examiner*—Stephen C. Pellegrino
*Attorney, Agent, or Firm*—Henderson & Sturm

[57] ABSTRACT

The invention relates to devices employed to contain and dispense snuff and the like. Reduction of tendencies to jam and enhance compactness, portability and operability are achieved by an inhaler (12) bearing a projection (21), attached over a member (13) having snuff storage bores (33). Rotation of the inhaler aligns the projection with each bore sequentially. Structure (14) is provided for facilitating, and temporarily locking, this alignment.

5 Claims, 5 Drawing Figures

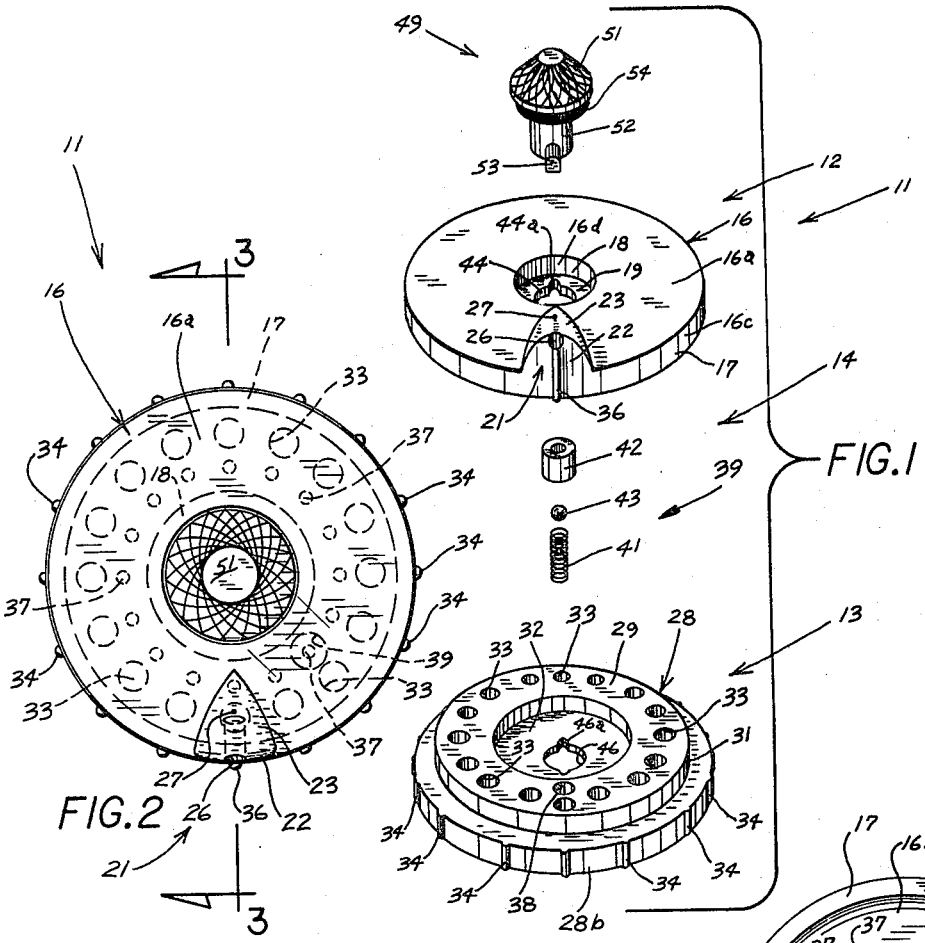
FIG.1
FIG.2
3
3
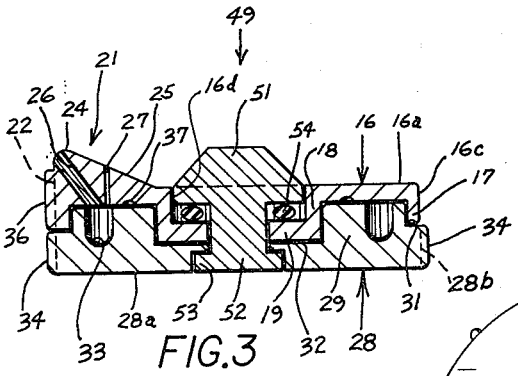
FIG.3
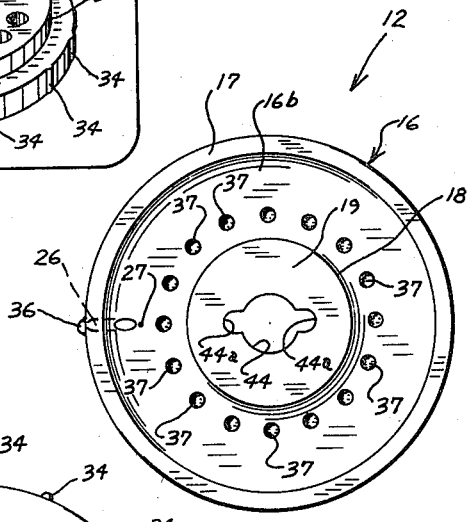
FIG.5
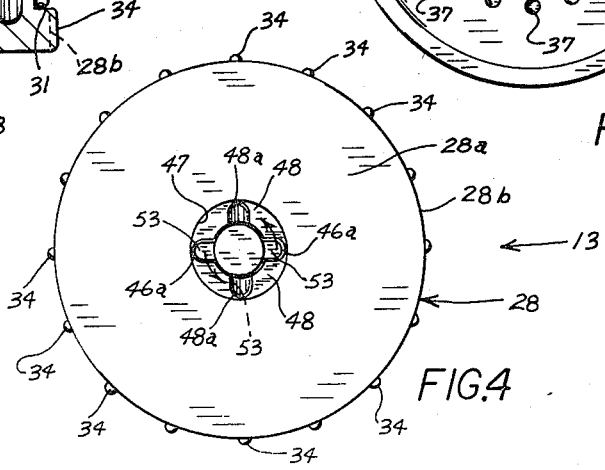
FIG.4

SNUFF DISPENSER

TECHNICAL FIELD

This invention relates generally to apparatus for containing and dispensing pulverized or powdered materials. Although this invention may be employed for various medicaments, more particularly this invention is for preparations of pulverized tobacco and relates to snuff boxes and the like.

BACKGROUND ART

Snuff boxes and the like have been around for some time. Primarily these devices have comprised a container portion with a lid or cover attached thereto by hinges. The cover was opened by hand and the desired amount of snuff grasped and drawn out.

Devices of more complex structure have been devised more recently for dispensing medicines and the like. Many of these devices require specially constructed capsules for storage of the medicine and/or specially constructed apparatus for engaging the nose or mouth of the user. Those devices of less complex structure are limited to one dosage or use. Those devices which attempt to provide for multiple usages are susceptible to jamming and/or not readily adjustable to provide for different unit quantities or dosages.

DISCLOSURE OF INVENTION

This invention of a snuff box provides an inhaler member and a storage member rotatably connected. A series of bores in the storage member each contain a desired amount of snuff, and the inhaler member covers the bores. A raised, nose engaging portion is carried by the inhaler member into alignment with each of the bores sequentially; and structure is provided for facilitating, and temporarily locking, this alignment.

It is an object of this invention to provide a snuff dispenser which need not be operated in conjunction with container capsules of special construction.

Another object of this invention is the provision of a snuff dispenser which permits variation of the unit quantities of snuff to be temporarily stored and dispensed.

Also an object of this invention is provision of a snuff dispenser having storage, measuring, indexing and locking mechanisms which are less likely to jam.

A further object of this invention is provision of a snuff dispenser of more compact construction, thereby enhancing portability, yet capable of achieving the aforementioned objects.

These objects and other features and advantages of this snuff dispenser invention will become readily apparent upon referring to the following description in conjunction with the appended drawings.

BRIEF DESCRIPTION OF THE DRAWINGS

The snuff dispenser invention is illustrated in the drawings wherein:

FIG. 1 is an exploded, perspective view of the invention;

FIG. 2 is an enlarged, top plan view of the invention;

FIG. 3 is an enlarged, cross section of the invention taken along line 3–3 of FIG. 2;

FIG. 4 is an enlarged, bottom plan view of the snuff dispenser storage member; and FIG. 5 is an enlarged, bottom plan view of the snuff dispenser inhaler member.

BEST MODE FOR CARRYING OUT THE INVENTION

This invention of a snuff dispenser is shown generally at 11 in FIG. 1. The dispenser 11 more particularly includes an inhaler member 12, a storage member 13 and a lock and index assembly 14.

The inhaler member 12 includes a unitary annular plate 16 having a top, exterior surface 16*a*, a bottom, interior surface 16*b*, a peripheral surface 16*c* and an inner surface 16*d*. Joined to plate 16, adjacent peripheral surface 16*c*, is a depending flange 17. A depending annular wall 18 is joined to plate 16 adjacent inner surface 16*d*. A second annular plate 19 is joined to the lower portion of the annular wall 18.

A projection 21 extends upwardly from surface 16*a*. The projection 21 includes a front surface 22 which is contiguous with, and curved in approximately the same fashion as, the peripheral surface 16*c*. A sloping surface 23 extends from the front surface 22 to the top surface 16*a*. The surfaces 22, 23 form an apex 24; and the surface 23 has a ridge 25 extending from the apex 24 to surface 16*a* in alignment with a radius of the dispenser 11 when viewed in plan (FIG. 2). Also when viewed in plan, the projection 21 tapers from a relatively greater width at surface 22 to a relatively narrow width adjacent the juncture of the ridge 25 with the surface 16*a*.

A first bore, or snuff passage, 26 is formed through projection 21, extending from the apex 24, downwardly at an angle toward wall 18, and through bottom plate surface 16*b*. A second bore, or air passage, 27 also is formed through projection 21, the ridge 25 thereof and bottom surface 16*b*. The axes of bores 26, 27 are disposed in a plane normal to surfaces 16*a*, *b* and passing through ridge 25.

The storage member 13 (FIGS. 1 and 4) includes a plate 28 having a bottom surface 28*a* and peripheral surface 28*b*. Opposite surface 29*a* is an annular raised portion 29 which defines a peripheral shoulder area 31 and a central floor surface 32. A series of storage bores 33 are formed into the raised portion 29 toward the shoulder area 31, the axes thereof being normal to the surface 28*a* plane. The bores 33 are radially spaced apart.

The lock and index assembly 14 includes a series of ridges 34 formed on the peripheral surface 28*b*. The ridges 34 extend from shoulder area 31 to the surface 28*a*, have longitudinal axes normal to surface 28*a* plane, and are radially spaced apart. An index ridge 36 is formed on front surface 22, extends from apex 24 to the bottom of flange 17, and is disposed in the same plane as bores 26, 27 and ridge 25.

A plurality of ball check cups 37 (FIG. 5) are formed into inside surface 16*b* toward wall 18. A ball check bore 38 is formed into, and normal to, raised surface area 29 toward the central floor 32. A ball check member 39 (FIG. 1) includes a spring 41 disposed within the bore 38, a race 42 disposed upon the spring 41 within the bore 38, and a ball 43 disposed within the race 42.

The central aperture 44 of annular plate 19 has formed into the side wall thereof opposed grooves 44*a* disposed normal to plate 19. A second aperture 46, also with opposed grooves 46*a*, is cut through floor surface 32 and communicates with a centrally disposed countersunken area 47 formed into bottom surface 28*a*. Two cams 48 are disposed within the countersunken area 47, each cam 48 having ramp-like surfaces which begin at grooves 46*a* and meet at a notch 48*a* at a maximum distance away from surface 32.

A lock member 49 includes a knurled member 51 fixed to one end of a shaft 52. A pair of cam pins 53 are fixed at the opposite end of shaft 52. The pins 53 are opposed and extend normal to the longitudinal axis of shaft 52. A washer 54 fits, over the pins 53 and shaft 52, up against the member 51.

The dispenser 11 is assembled by fitting the members 12, 13 together. The annular wall 18 is disposed against the inside wall of the annular raised portion 29 and the plate 19 against the central floor surface 32. The flange 17 is disposed in the shoulder area 31.

The members 12, 13 are then rotated with respect to each other such that the opposed grooves 44*a*, 46*a* are aligned. The lock member 49 thereafter is grasped at 51 and passed through apertures 44, 46, the pins 53 traversing the aligned grooves 44*a*, 46*a*. Rotation of the lock member 49 (indicated by arrows in FIG. 4) causes the pins 53 to travel along the cam surfaces 48, drawing the member 51 toward plate 19 and tightening plates 12, 13 together. The lock member 49 is shown at the beginning of the locking rotation in solid lines at FIG. 4 and at the end of the rotation in FIG. 5 and dotted lines at FIG. 4, the washer 54 separating member 51 from plate 19, the pins 53 moving to rest in notches 48*a*.

The dispenser 11 components may be milled or die cast, by techniques well known, from aluminum. Or the dispenser 11 may be formed of injection molded plastic components. The washer 54 is composed of a suitable resilient material.

Prior to assembling the inhaler 12 to the storage member 13, snuff is placed in the storage bores 33. The user may fill the bores 33 completely or with a preferred lesser quantity. Thereafter, the dispenser 11 is assembled as aforementioned. The inhaler 12 is rotated slightly with respect to the storage member 13 until the ball 43 engages a ball check cup 37. The dispenser 11 is then ready for use.

The ridges 34, storage bores 33 and ball check cups 37 have been radially spaced apart a like degree. Each ridge 34 is aligned with a bore 33 along a radius of storage member 13, and the ball check bore 38 is disposed along one such radius. The index ridge 36, first and second bore 26, 27 openings, and a ball check cup 37 are disposed along one radius of the inhaler 12. When the dispenser 11 is assembled, rotation of the inhaler 12 causes the series of cups 37 to pass directly over the ball check 39 and the first and second bore 26, 27 openings to pass directly over the series of storage bores 33.

The inhaler 12 is positioned such that projection 21 is disposed in the user's nostril far enough to cover the first bore 26 opening.

As the user inhales, snuff travels outward through passageway 26, and air travels through bore 27 to the storage bore 33. If the user desires more snuff, inhaler 12 is rotated with respect to member 13 until index ridge 36 is aligned with the next adjacent ridge 34. The ball check 39 moves downwardly to permit the rotation and then back up as the ball 43 engages the next cup 37, thereby temporarily locking the dispenser 11 in the next use position. The projection 21 now is disposed over the next storage bore 33, and the snuff may be inhaled as aforementioned.

The ridges 34, 36 provide visual location of the covered storage bores 33 and also facilitate rotation of the inhaler 12 with respect to the member 13. The pins 53 and shaft 52 do not extend beyond the surface 28*a* plane; and special storage capsule or inhaler attachments are not required by this dispenser 11; and furthermore, inhaler 12 and member 13 nest together in a compact manner, all providing for superior compactness, portability and operability. The manner of storage of the snuff by dispenser 11 reduces tendencies of same to jam movement of inhaler 12 with respect to member 13. The snuff or the like is well shielded from contamination by the dispenser 11.

The industrial applicability of the dispenser 11 is believed apparent from the foregoing description. Although a best mode has been disclosed herein, various modifications and alternate constructions can be made without departing from the scope of the invention.

I claim:

1. A snuff dispenser comprising:

storage means for snuff including a bottom plate, an annular raised member joined to said bottom plate and forming central and annular shoulder areas, and storage bores formed into said annular raised member wherein snuff is removably disposable; and cover means attached to said storage means and including an annular plate, inner and outer circular walls depending from said annular plate, and inhaler means fixed to said annular plate, said inner and outer circular walls fitting into said central and annular shoulder areas respectively and abutting said annular raised member, said annular plate resting upon said annular raised member, rotation of said cover means with respect to said storage means moving said inhaler means into register with said storage bores serially.

2. The snuff dispenser of claim 1 and further wherein said inhaler means includes a raised area fixed to said annular plate and having a first surface extending upwardly from said outer circular wall, a snuff passageway being formed through said first surface, through said raised area, and through said annular plate.

3. The snuff dispenser of claim 2 and further wherein said first surface bears an index projection, said bottom plate bearing means for grasping and indexing.

4. The snuff dispenser of claim 1 or 2 and further wherein a ball check means is attached to said annular raised area, a plurality of ball check cups being formed in said annular plate and being serially engageable by said ball check means, upon rotation of said cover means with respect to said storage means, each time to temporarily lock said inhaler means in register with one of said storage bores.

5. The snuff dispenser of claim 1 or 2 and further wherein a third plate is fixed to said inner circular walls, fits into and spans said central area, and abuts said bottom plate, a countersink is formed into said bottom place which communicates with said central area, and attachment means, for tightening said cover means against said storage means, is disposed within said inner circular wall and extends through said third plate, central area, and bottom plate into said countersink.

* * * * *